US008197009B2

(12) United States Patent
Whelan et al.

(10) Patent No.: US 8,197,009 B2
(45) **Date of Patent: *Jun. 12, 2012**

(54) WHEELCHAIR SEATBACK WITH TWO-POINT MOUNTING HARDWARE

(75) Inventors: Thomas J. Whelan, Longmont, CO (US); James L. Christofferson, Longmont, CO (US); Vincent J. Frerich, Arvada, CO (US); Sy Tran, Longmont, CO (US)

(73) Assignee: Sunrise Medical (US) LLC, Fresno, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/963,713

(22) Filed: Dec. 9, 2010

(65) Prior Publication Data

US 2011/0080031 A1 Apr. 7, 2011

Related U.S. Application Data

(63) Continuation of application No. 12/075,181, filed on Mar. 10, 2008, now Pat. No. 7,857,394.

(60) Provisional application No. 60/905,658, filed on Mar. 8, 2007.

(51) Int. Cl.
*A47C 7/42* (2006.01)
*A47C 7/00* (2006.01)

(52) U.S. Cl. ..... 297/440.2; 297/DIG. 4

(58) Field of Classification Search ..... 297/440.1, 297/440.2, 440.21, DIG. 4
See application file for complete search history.

(56) References Cited

U.S. PATENT DOCUMENTS

| | | | | |
|---|---|---|---|---|
| 3,410,600 | A * | 11/1968 | Thorpe | 296/66 |
| 3,843,083 | A | 10/1974 | Angibaud | |
| 3,986,746 | A | 10/1976 | Chartier | |
| 4,601,451 | A | 7/1986 | Leonardo | |
| 5,302,039 | A | 4/1994 | Omholt | |
| 5,364,162 | A | 11/1994 | Bar | |
| 5,556,168 | A | 9/1996 | Dinsmoor et al. | |
| 5,947,562 | A | 9/1999 | Christofferson et al. | |
| 6,095,611 | A | 8/2000 | Bar et al. | |
| 6,257,664 | B1 | 7/2001 | Chew et al. | |
| 6,460,933 | B1 | 10/2002 | Bors et al. | |
| 6,474,743 | B1 | 11/2002 | Harker et al. | |
| 6,659,563 | B2 | 12/2003 | Float et al. | |
| 7,066,549 | B2 | 6/2006 | Dennon et al. | |

(Continued)

FOREIGN PATENT DOCUMENTS

EP 2070501 A2 6/2009

(Continued)

OTHER PUBLICATIONS

Cascade Designs, Inc.; Varilite Back System Hardware sales brochure, copyright 2007.

(Continued)

*Primary Examiner* — David Dunn
*Assistant Examiner* — Tania Abraham
(74) *Attorney, Agent, or Firm* — MacMillan, Sobanski & Todd, LLC

(57) ABSTRACT

Wheelchair seat back mounting hardware permits the seat back to be mounted on various wheelchairs. The mounting hardware may be in the form of two-point mounting hardware that connects the seat back to the wheelchair and permits the seat back height to be adjusted independently of the mounting hardware location on the wheelchair.

7 Claims, 7 Drawing Sheets

U.S. PATENT DOCUMENTS

| | | | |
|---|---|---|---|
| 7,104,610 | B2 | 9/2006 | Cramer |
| 2003/0102706 | A1 | 6/2003 | Float |
| 2004/0066081 | A1 | 4/2004 | Dennon |
| 2006/0076815 | A1 | 4/2006 | Cramer |
| 2008/0157581 | A1 | 7/2008 | Whelan et al. |
| 2008/0217880 | A1 | 9/2008 | Whelan et al. |

FOREIGN PATENT DOCUMENTS

| | | |
|---|---|---|
| WO | 0228339 | 4/2002 |

OTHER PUBLICATIONS

Cascade Designs, Inc.; Evolution Back sales brochure, copyright 2005.

Cascade Designs, Inc.; Evolution Back Hardware sell sheet, copyright 2006.

Web page print out (http://www.ptproductsonline.com/issues/articles/2006-07_06.asp), Physical Therapy Products, product profiles section, Jul.-Aug. 2006.

* cited by examiner

WHEELCHAIR SEATBACK WITH TWO-POINT MOUNTING HARDWARE

RELATED APPLICATIONS

This application is a Continuation of U.S. patent application Ser. No. 12/075,181, currently pending, filed Mar. 10, 2008, and entitled wheelchair seat back with two-point mounting hardware. Application Ser. No. 12/075,181 claims priority from U.S. Provisional Patent Application Ser. No. 60/905,658, filed Mar. 8, 2007, and entitled WHEELCHAIR SEAT BACK WITH TWO-POINT MOUNTING HARDWARE. Both priority documents are incorporated in the present application in their entirety.

BACKGROUND

The present invention generally relates to wheelchairs, and more particularly to wheelchair seat backs.

A wheelchair comprises a base supported for movement relative to a supporting surface by wheels, typically differentially driven wheels and caster wheels. A seat assembly is supported in relation to the base for supporting a user. The seat assembly comprises a seat and a seat back is supported in relation to the seat. The seat back is typically supported by seat canes or posts. A seat back is conventionally mounted to the posts by four-point mounting hardware.

To properly support and position the wheelchair user, many anatomical and physiological factors may be considered. The needs of the user can be compensated for by adjusting seat back contours, height, angle and depth.

Wheelchairs are manufactured using a wide range of tube diameters and shapes. This may present a challenge when designing products, such as seat backs, that are intended to fit on different style wheelchairs.

Seat backs that are intended to fit onto various wheelchairs may be limited in achieving the correct anatomical height for the seat back by virtue of the design of the wheelchair and seat back mounting hardware. Most seat backs are mounted to the wheelchair at four points (i.e., two points on each seat back post). If the wheelchair structure has limitations regarding where these four points can be, it may compromise the height position of the seat back to the user's anatomical and/or physiological needs.

SUMMARY OF INVENTION

The According to this invention there is provided a wheelchair seat back assembly comprising a seat back and mounting hardware for mounting the wheelchair seat back in relation to wheelchair seat posts. The mounting hardware includes a mounting pin configured to be mounted in relation to one of the wheelchair seat posts or the seat back, and a pin receiver configured to be mounted in relation to the other one of the wheelchair seat posts or the seat back. The mounting pin is structured to be received by the pin receiver to mount the seat back in relation to the wheelchair seat posts. The mounting pin is tapered and the pin receiver is tapered, thereby enabling the tapered shape of the mounting pin to cooperate with the tapered shape of the pin receiver to form a firm contact between the mounting pin and the pin receiver.

According to this invention there is also provided a wheelchair seat back assembly including a seat back and mounting hardware for mounting the wheelchair seat back in relation to wheelchair seat posts. The mounting hardware has a mounting pin configured to be mounted in relation to one of the wheelchair seat posts or the seat back, and a pin receiver configured to be mounted in relation to the other one of the wheelchair seat posts or the seat back. The mounting pin is structured to be received by the pin receiver to mount the seat back in relation to the wheelchair seat posts, wherein the mounting pin and the pin receiver are conically shaped.

According to this invention there is also provided a wheelchair seat back assembly including a seat back and mounting hardware for mounting the wheelchair seat back in relation to wheelchair seat posts. The mounting hardware has a mounting pin configured to be mounted in relation to one of the wheelchair seat posts or the seat back and a pin receiver configured to be mounted in relation to the other one of the wheelchair seat posts or the seat back. The mounting pin is structured to be received by the pin receiver to mount the seat back in relation to the wheelchair seat posts. The mounting hardware further includes a pivotally mounted locking lever configured to be pivoted between a locked position, in which the pin is locked in the pin receiver, and an unlocked position, in which the pin can be removed from the pin receiver. The locking lever, when pivoted to the unlocked position, is positioned in a relation with the mounting pin so that removal of the mounting pin from the pin receiver results in a pivoting of the locking lever to the locked position, and when the locking lever is in the locked position, the wheelchair seat back can be re-mounted onto the wheelchair and locked in place by inserting the pin into the pin receiver, without requiring additional adjustment of the locking lever to achieve the locked position. The mounting pin is tapered and the pin receiver is tapered, thereby enabling the tapered shape of the mounting pin to cooperate with the tapered shape of the pin receiver to form a firm contact between the mounting pin and the pin receiver.

DETAILED DESCRIPTION

Figure 1:
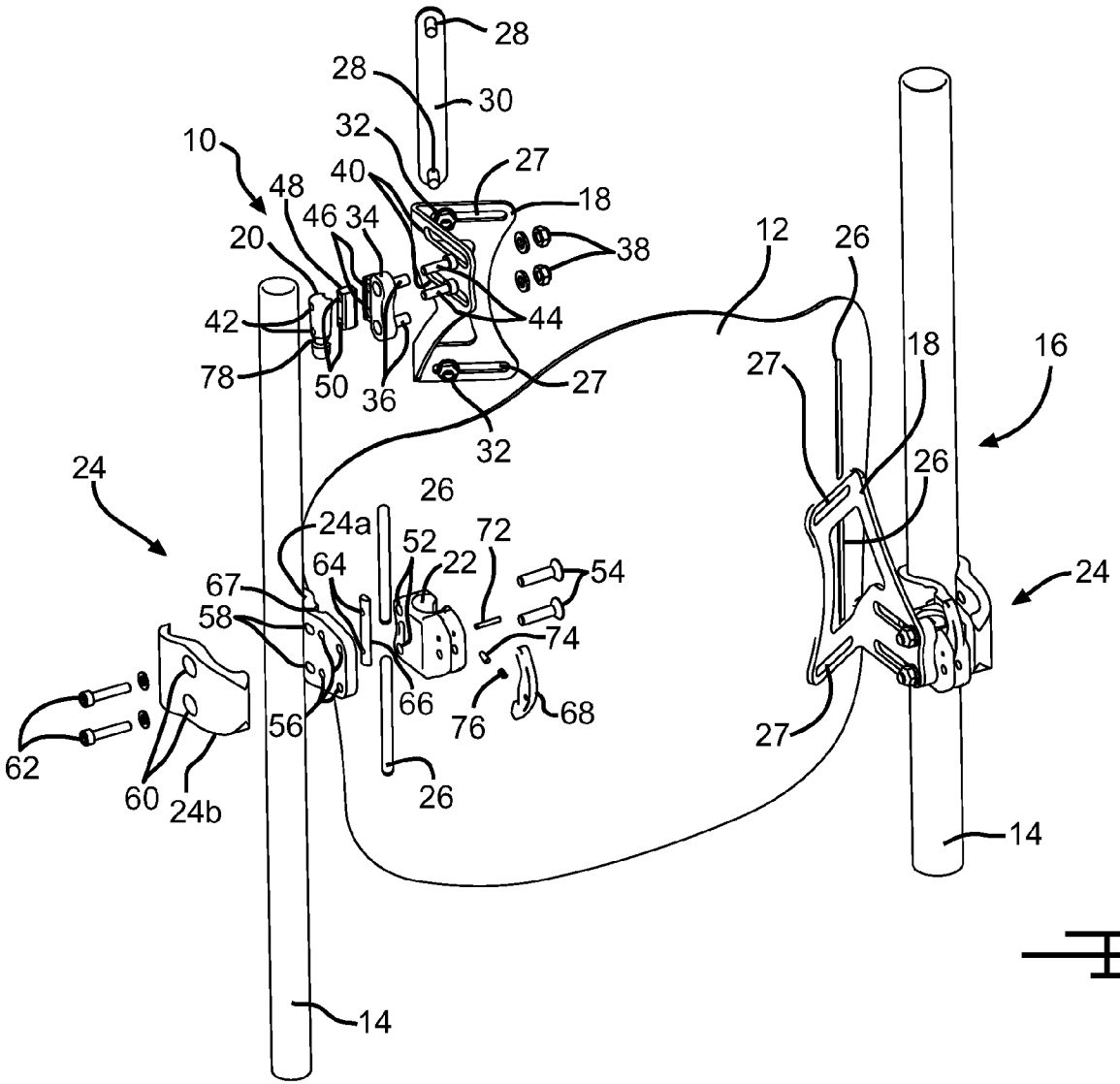
FIG. 1 is a partially exploded rear perspective view of an exemplary wheelchair seat back assembly.

Referring now to the drawings, there is illustrated in FIG. 1 a partially exploded rear perspective view of an exemplary wheelchair seat back assembly, generally indicated at 10. The seat back assembly 10 may be generally comprised of a seat back 12, which may be made of any suitable material and which may be suitable shape or configuration. The seat back 12 is supported in relation to the seat canes or posts 14 of a wheelchair by mounting hardware 16.

The exemplary mounting hardware 16 has four basic components, namely, a mounting bracket 18, a mounting pin 20, a pin receiver 22, and a clamp, such as the tube clamp 24 shown, although other hardware configurations may be suitable for practicing the invention.

As clearly shown in the drawings, the mounting bracket 18 is attachable to the seat back 12 and the mounting pin 20 is supported in relation to the mounting bracket 18. The tube clamp 24 is attachable to the posts 14 and the pin receiver 22 is supported in relation to the tube clamp 24. Conversely, it should be appreciated that the mounting pin 20 may be supported in relation to the tube clamp 24 and the pin receiver 22 may be supported in relation to the mounting bracket 18.

The mounting bracket 18 may be attached to the seat back 12 in any suitable manner. For example, openings, holes or slots may be provided in the seat back 12. Similar openings, holes or slots may be provided in the mounting bracket 18. The openings, holes or slots in the mounting bracket 18 align with the openings, holes or slots in the seat back 12 for receiving fasteners for attaching the mounting bracket 18 to the seat back 12.

In the drawings, slots 26 are provided in the seat back 12. Similar slots 27 are provided in the mounting bracket 18. The slots 26, 27 are adjustable in relation to one another to permit the seat back to be adjusted in relation to the mounting bracket 18. The exemplary slots 26 in the seat back 12 extend vertically to permit the mounting bracket 18 to be adjusted vertically. The slots 27 in the mounting bracket 18 extend horizontally to permit the mounting bracket 18 to be adjusted horizontally. Conversely, the slots 26 in the seat back 12 may extend horizontally and the slots 27 in the mounting bracket 18 may extend vertically. It should be appreciated that the slots 26, 27 may be extend in directions other than the vertical and horizontal directions shown, or that other arrangements may be provided that permit varying degrees of adjustment of the mounting bracket 18 in relation to the seat back 12.

Any suitable fasteners may be used to attach the mounting bracket 18 to the seat back 12. The exemplary fasteners are threaded fasteners 28 held in fixed relation to one another by a stud plate 30. The stud plate 30 may be situated forward of the seat back 12 so that the threaded fasteners 28 extend rearward through the slots 26, 27. Nuts 32 may be threaded onto the threaded fasteners 28 and tightened to secure the mounting bracket 18 in place. The mounting bracket 18 may be adjusted by loosening the nuts 32 and again held in place by tightening the nuts 32. Instead of using a stud plate 30, it should be appreciated that the nuts 32 may be held in fixed relation to one another by a nut plate and the threaded fasteners 28 may be separately threaded into the nuts 32. Alternatively, other fasteners and fastening arrangements may be suitable for attaching the mounting bracket 18 to the seat back 12.

The exemplary mounting pin 20 is supported in relation to the mounting bracket 18 by a pin holder 34, which may be attached to mounting bracket 18. Although the pin holder 34 may be attached in any suitable manner, the exemplary pin holder 34 has threaded studs 36 and the mounting bracket 18 has openings, holes or slots for receiving the threaded studs 36. Nuts 38 may be threaded onto the threaded studs 36 to attach the pin holder 34 to the mounting bracket 18. It should be appreciated that the threaded studs 36 may be loosely arranged or form an integral part of the pin holder 34 as shown. Alternatively, the pin holder 34 may be threaded to receive threaded fasteners.

The exemplary mounting bracket 18 has slots 40 for receiving the threaded studs 36. The slots 40 may be oversized (i.e., larger in dimension than the threaded studs 36). This may permit angular adjustment of the pin holder 34 in relation to the mounting bracket 18, which will be described in greater detail in the description that follows. The mounting pin 20 is supported in relation to the pin holder 34. Though this may be done in any suitable manner, the exemplary pin holder 34 has threaded holes 42 for receiving threaded fasteners 44. The threaded holes 42 are arranged to align with through holes 46 in the pin holder 34. The threaded fasteners 44 may pass through the through holes 46 and thread into the threaded holes 42. The mounting pin 20 may be secured in place by tightening the threaded fasteners 44.

As will become apparent in the description that follows, the exemplary mounting pin 20 is conically shaped and the pin receiver 22 is conically shaped. A spacer 48 may be provided between the mounting pin 20 and the pin holder 34 to provide clearance between the mounting pin 20 and the pin holder 34 that may aid in the cooperation of the conically shaped mounting pin 20 and the conically shaped pin receiver 22. The spacer 48 may be provided with through holes 50 that are arranged to align with the through holes 46 in the in the pin holder 34 and the threaded holes 42 in the mounting pin 20 to permit passage of the threaded fasteners 44 through the spacer 48 so that the threaded fasteners 44 may thread into the threaded holes 42.

The pin receiver 22 may be supported in relation to the tube clamp 24 in any suitable manner. For example, the exemplary pin receiver 22 is provided with through holes 52 for receiving threaded fasteners 54, which may be threaded into threaded holes in the tube clamp 24, such as the threaded holes 56 in an inner part 24*a* of the tube clamp 24, as illustrated in the drawings. The tube clamp 24 may be provided with multiple threaded holes to permit the pin receiver 22 to be attached to the tube clamp 24 in a plurality of positions.

The exemplary tube clamp 24 is sized and configured to be clamped upon various size posts 14. Although the tube clamps 24 may be any suitable configuration, the exemplary tube clamp 24 has two parts, the inner part 24*a* mentioned above and an outer part 24*b*. The two parts may have one or more through holes, such as the through holes 58, 60 shown, for receiving threaded fasteners 62. The threaded fasteners 62 may be threaded into threaded holes 64 in a swivel pin 66, which is sized to fit in a relief 67 in the inner part 24*a* of the tube clamp 24. The swivel pin 66 permits the inner and outer parts 24*a*, 24*b* of the tube clamp 24 to be positioned at various angles relative to one another, depending on the size of the posts 14, as will become clear in the description that follows.

The exemplary pin receiver 22 is a self-locking pin receiver with a two-position locking lever 68, which is held in pivotal relation to the pin receiver 22 by a dowel pin 72. The locking lever 68 may be alternatively held in either one of the two positions by a latch plunger 74 biased by a compression spring 76.

Figures 2A, 2B, 2C, 2D:
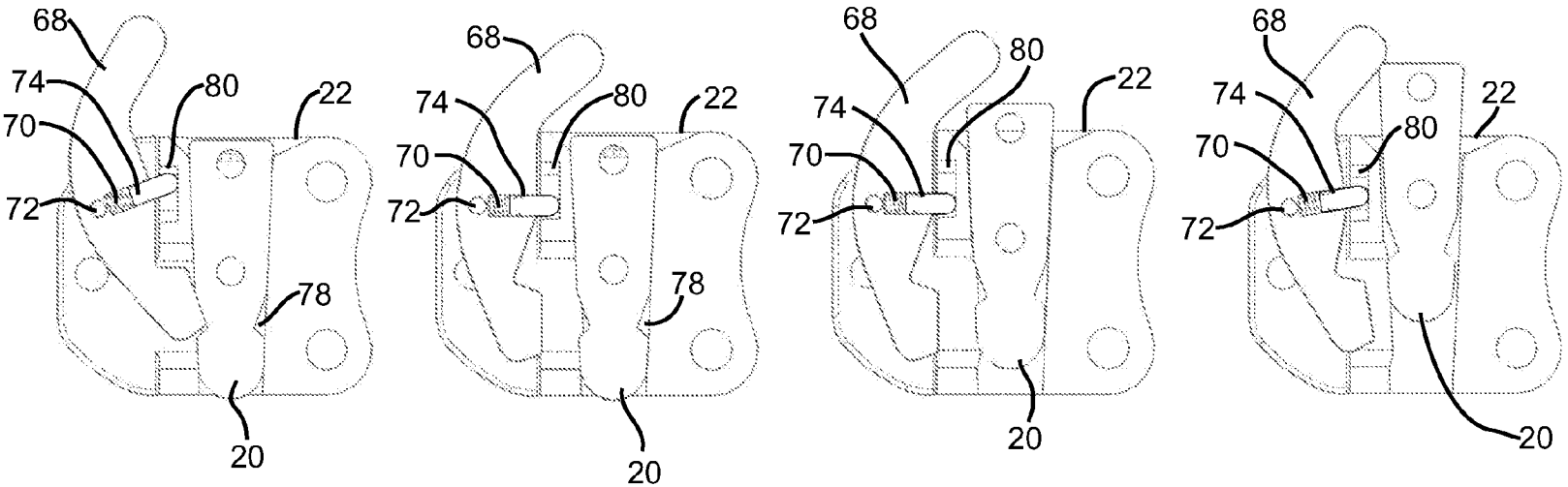
FIGS. 2A-2D are sectional views of an exemplary construction of a pin receiver in various positions of operation.

In FIGS. 2A-2D, there are illustrated sectional views of an exemplary construction of the pin receiver 22 in various positions of operation. In FIG. 2A, the locking lever 68 is in a first or locked position in engagement with a detent 78 in the mounting pin 20. The exemplary detent 78 is an annular detent. In this position, the mounting pin 20 is secured in the pin receiver 22. The compression spring 76 biases the latch plunger 74 in a first position (shown in FIG. 2A) in an elongated relief 80 in the pin receiver 22 and biases the locking lever 68 to hold the locking lever 68 in the locked position, into engagement with the detent 78. As stated above, the mounting pin 20 and the pin receiver 22 may be conically shaped. It should be appreciated that the conical shape of the mounting pin 20 may cooperate with the conical shape of the pin receiver 22 to form firm contact between the mounting pin 20 and the pin receiver 22.

In FIG. 2B, the locking lever 68 has been moved to a second or unlocked position, or clockwise about the dowel pin 72 when viewing FIG. 2B. In this position, the locking lever 68 is disengaged from the detent 78 in the mounting pin 20. The latch plunger 74 is moved (clockwise when viewing FIG. 2B) in a second position (shown in FIG. 2B) in the elongated relief 80 in the pin receiver 22. In this position, the compression spring 76 biases the locking lever 68 to hold the locking lever 68 in the second, unlocked position, out of engagement with the detent 78 in the mounting pin 20 to permit the mounting pin 20 to be freely removed (i.e., moved vertically upward when viewing FIGS. 2C and 2D) from the pin receiver 22. This permits the seat back 12 to be readily detached from the posts 14 without the aid of tools.

In FIG. 2D, the mounting pin 20 has been moved sufficiently upward to engage the locking lever 68. Upon engaging the locking lever 68, the locking lever 68 is displaced (i.e., moved counter-clockwise about the dowel pin 72 when viewing FIG. 2D). It can be seen from FIG. 2C that when the locking lever 68 is pivoted to the unlocked position, it is positioned in an interference relation with the mounting pin 20 so that removal of the mounting pin 20 from the pin receiver 22 causes contact between the mounting pin 20 and the locking lever 68, thereby pivoting the locking lever 68 to the locked position, as illustrated in FIG. 2D. The latch plunger 74 is moved (counter clockwise when viewing FIG. 2D) back to the second position (shown in FIG. 2A) in the elongated relief 80 in the pin receiver 22. In this position, the compression spring 76 biases the locking lever 68 counter-clockwise back into the first position, as shown in FIG. 2A. The mounting pin 20, when inserted back into the pin receiver 22, engages the locking lever 68 and cams the locking lever 68 clockwise. With the mounting pin 20 sufficiently inserted in the pin receiver 22, the locking lever 68 is biased by the compression spring 76 back into engagement with the detent 78 in the mounting pin 20 to hold the mounting pin 20 firmly in the pin receiver 22. This permits the seat back 12 to be readily supported in relation to the posts 14 without the aid of tools.

It should be appreciated that the mounting pin 20 may be mounted in relation to the seat back 12 and the pin receiver 22 may be mounted in relation to the posts 14.

Figure 3A:
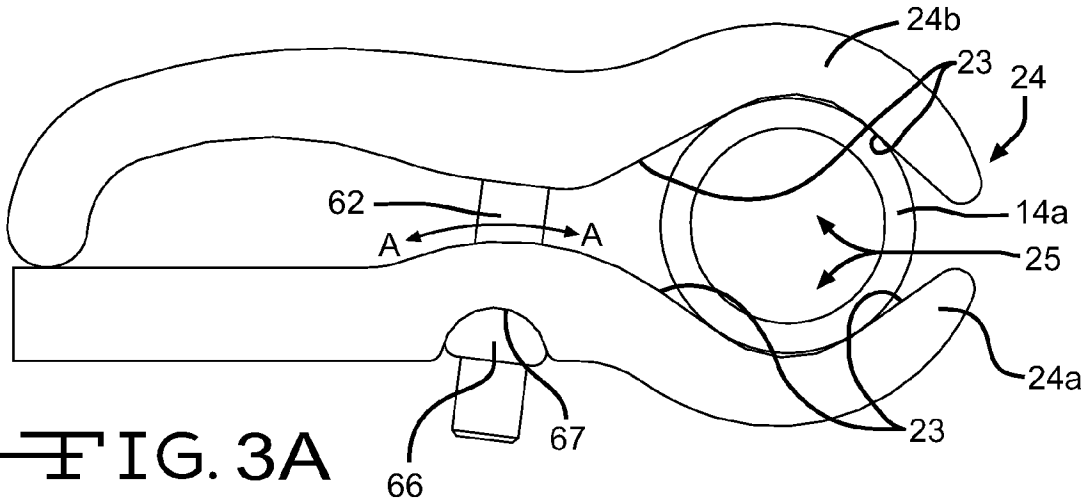
FIGS. 3A and 3B are top plan views of an exemplary tube clamp mounted in relation to different size seat posts.
Figure 3B:
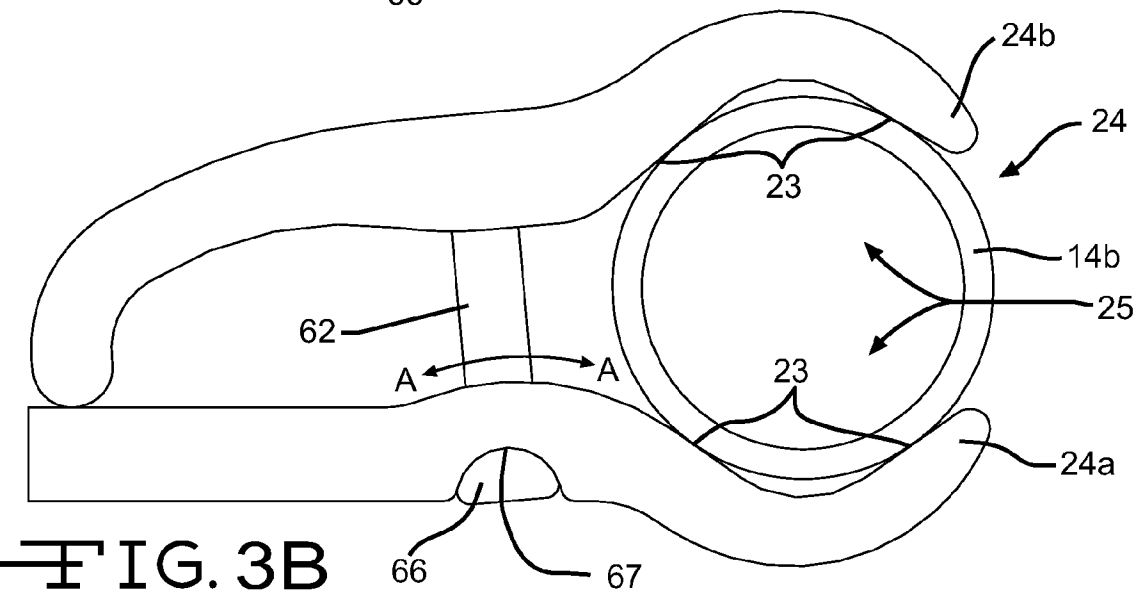

In FIGS. 3A and 3B, there are illustrated top plan views of the exemplary tube clamp mounted in relation to two different size posts 14*a* and 14*b*. In FIG. 3A, the tube clamp 24 is mounted to a relatively small post 14*a*. In FIG. 3B, the tube clamp 24 is mounted to a larger post 14*b*. As shown by comparison in the two drawings, the threaded fastener 62 has different approaches in relation to the inner part 24*a* of the tube clamp 24. To accommodate the different approaches, the swivel pin 66 is angularly displaceable (along the line A-A in FIGS. 3A and 3B) relative to the relief 67. The swivel pin 66, along with flats 23 defining a V-shaped geometry 25 of the inner and outer parts 24*a*, 24*b* of the tube clamp 24, permit the tube clamp 24 to be adapted to a variety of post sizes and shapes. It can be seen from FIG. 3A that the clamp forms a third class lever, with the contact between the inner and outer parts 24*a* and 24*b* forming a fulcrum at the rear end of the clamp 24, the front end of the clamp 24 applying a clamp force to the wheelchair posts 14, and the fastener 62 in conjunction with the swivel pin 66 providing an axial load at a position intermediate of the rear end and front end of the clamp 24.

Figure 4B:
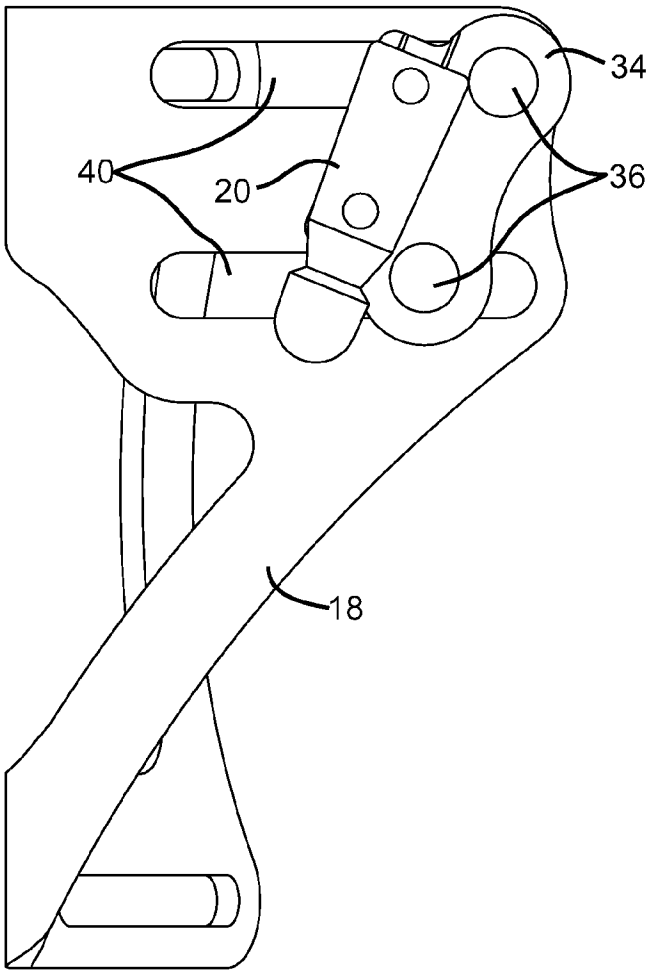
FIGS. 4A and 4B are side elevational views of an exemplary mounting bracket, pin holder and mounting pin, wherein the pin holder and the mounting pin are in two different angular positions.
Figure 4A:
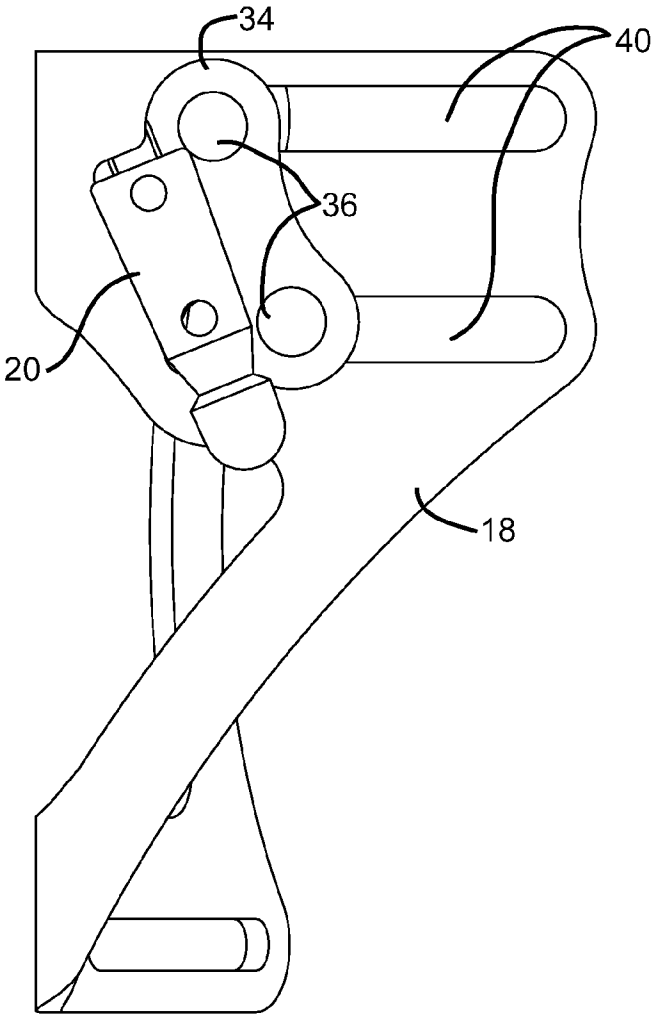

In FIGS. 4A and 4B, there are illustrated side elevational views of the exemplary mounting bracket 18, pin holder 34 and mounting pin 20, wherein the pin holder 34 and the mounting pin 20 are in two different angular positions. As stated above, the mounting bracket 18 may be provided with oversized slots 40. That is to say, the slots 40 may be larger in dimension than the threaded studs 36. This permits angular adjustment of the pin holder 34 in relation to the mounting bracket 18.

Figure 6:
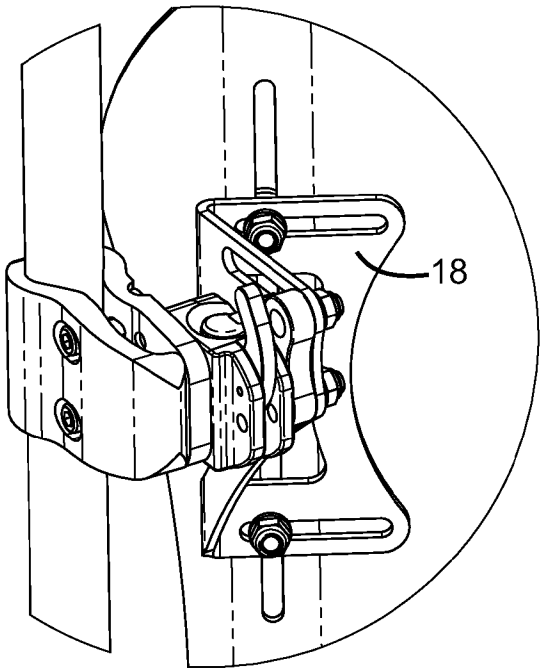
FIG. 6 is an enlarged rear perspective view of a moderately adjustable tall mounting bracket of the wheelchair seat back assembly shown in FIG. 5.
Figure 5:
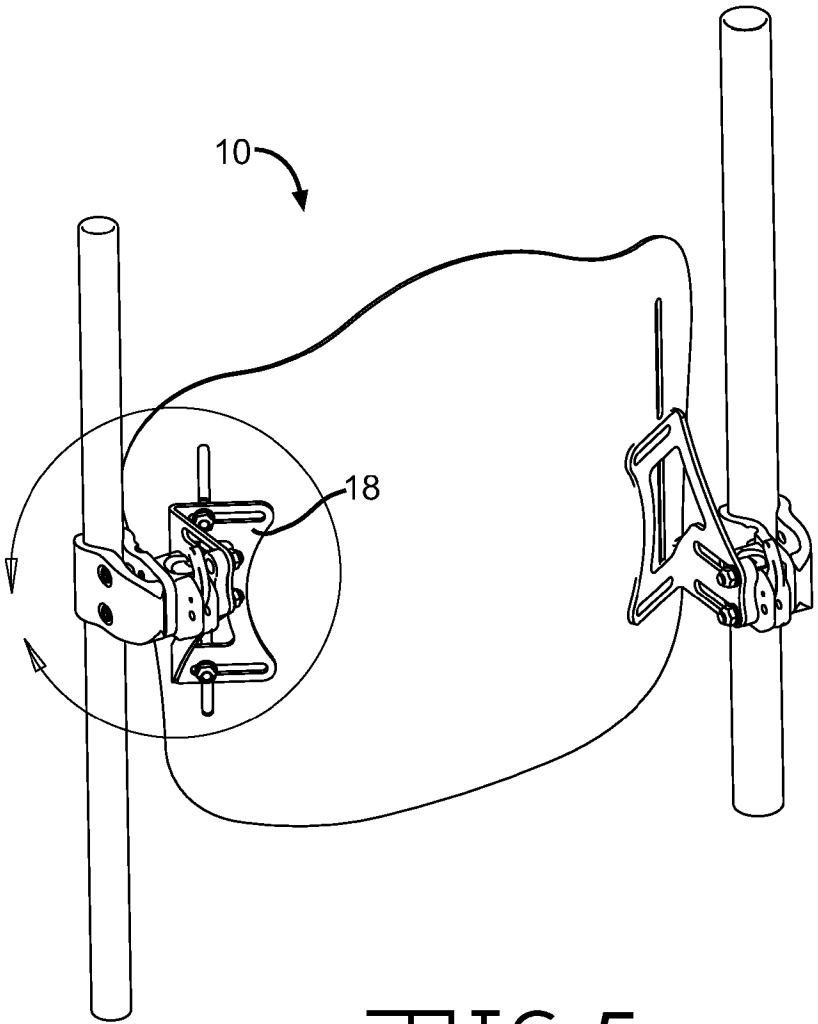
FIG. 5 is a rear perspective view of the wheelchair seat back assembly shown in FIG. 1.

In FIG. 5, there is illustrated a rear perspective view of the exemplary wheelchair seat back assembly 10 shown in FIG. 1. This seat back assembly 10 has a moderately adjustable tall mounting bracket 18, as shown enlarged in FIG. 6.

Figure 8:
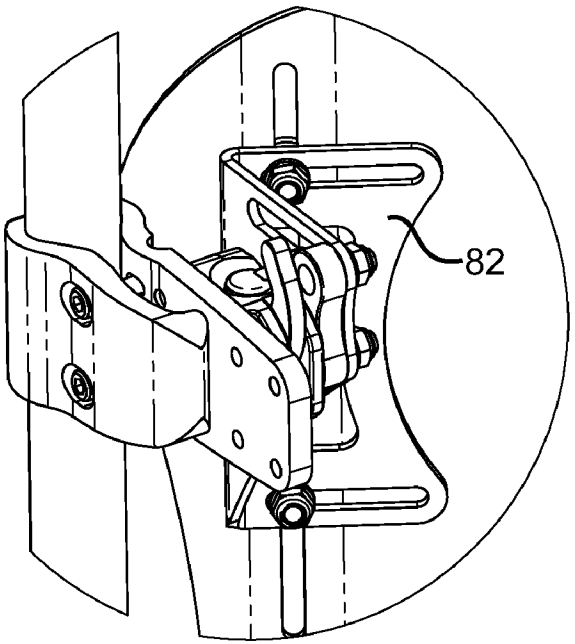
FIG. 8 is an enlarged rear perspective view of a highly adjustable tall mounting bracket of the wheelchair seat back assembly shown in FIG. 7.
Figure 7:
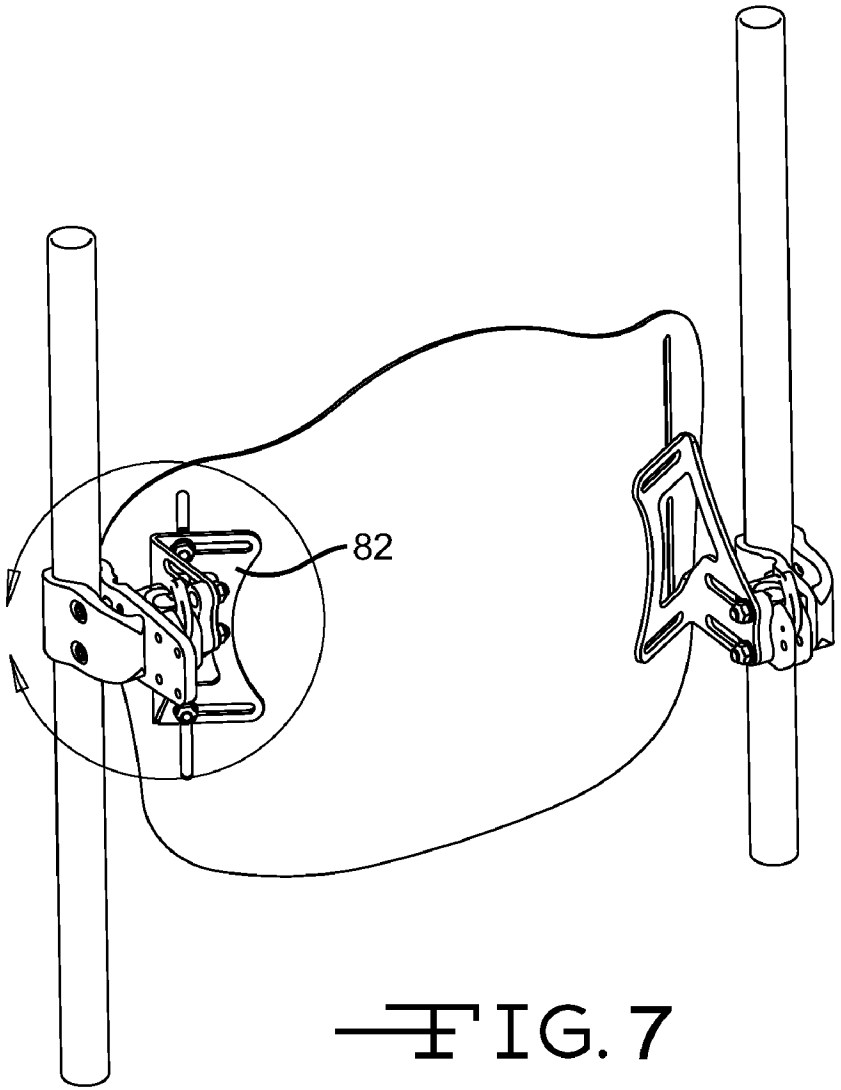
FIG. 7 is a rear perspective view of an alternative wheelchair seat back assembly.

In FIG. 7, there is illustrated a rear perspective view of an alternative wheelchair seat back assembly. This seat back assembly has a highly adjustable tall mounting bracket 82, as shown enlarged in FIG. 8.

Figure 10:
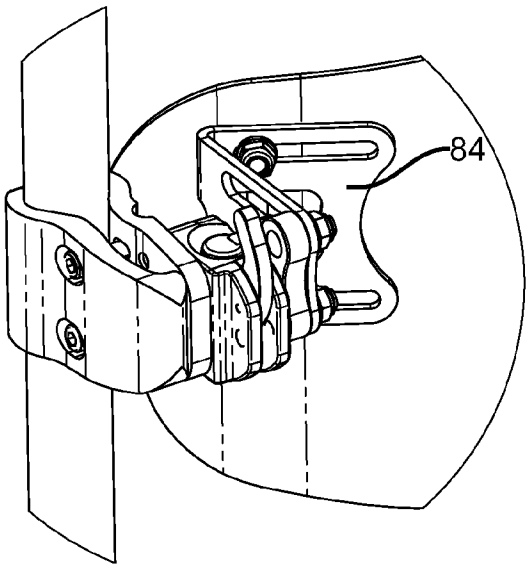
FIG. 10 is an enlarged rear perspective view of a moderately adjustable short mounting bracket of the wheelchair seat back assembly shown in FIG. 9.
Figure 9:
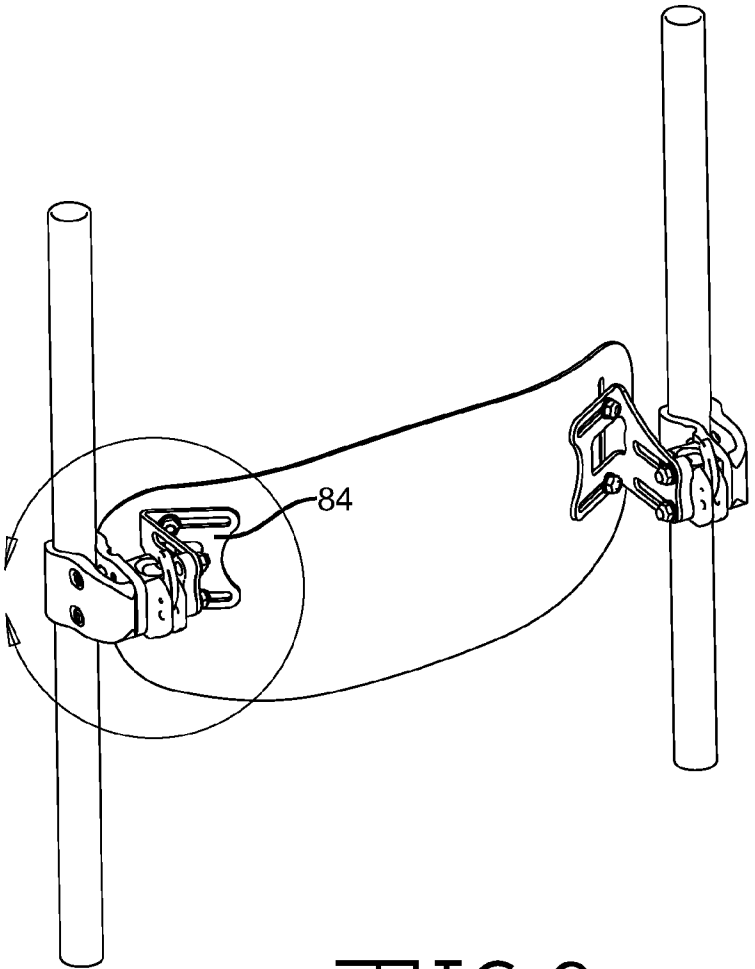
FIG. 9 is a rear perspective view of another wheelchair seat back assembly.

In FIG. 9, there is illustrated a rear perspective view of another wheelchair seat back assembly. This seat back assembly has a moderately adjustable short mounting bracket 84, as shown enlarged in FIG. 10.

The wheelchair seat back assemblies are quick release, detachable wheelchair seat back assemblies that fit onto various wheelchairs and seat back posts via a two-point mounting system, allowing independent adjustment of height, width, depth and angle of the seat back in order to meet the anatomical and physiological needs of the user.

The height of seat back rest can be fitted anatomically to user, regardless of wheelchair cushion height, or restrictions due to wheelchair seat back frame designs. Mounting hardware location on posts and mounting hardware location on seat back may be independent of each other.

The swivel pin has tapped holes, which can be made perpendicular to the mating clamp part.

The seat back may be easily attached to and detachable from the wheelchair or seat posts. The conical shaped mounting pin may be captured and secured in the pin receiver by the spring loaded locking lever that is biased to the two positions.

The mounting hardware is self-locking in an open position upon pushing the locking lever in a first direction. When detaching the seat back, the conical shaped mounting pin resets the locking lever into the biased closed position, such that when the seat back is reattached to the wheelchair, it securely self-locks into place.

The conical mounting pins are aligned to the pin receivers via numerous slots in the seat back and in the mounting brackets. The seat back may be adjustable to conform to the anatomical curves of a user via various geometric shaped blocks. These shaped blocks can be customized to the user, and are easily repositioned, and removable.

The seat back can adjust to various width ranges of wheelchairs, and also adjust in height, angle and depth. Width, height, angle and depth adjustments may be made via numerous slots, the orientation of which may contribute to the adjustments.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A wheelchair seat back assembly comprising a seat back and mounting hardware for mounting the seat back in relation to a seat post, the mounting hardware comprising a mounting pin having a taper and being configured to be mounted in relation to one of the seat post and the seat back, and a pin receiver having a taper and a latch assembly, the pin receiver being configured to be mounted in relation to the other one of the seat post and the seat back, the mounting pin being structured to be received by the pin receiver to mount the seat back in relation to the seat post, wherein the latch assembly is biased to stay in a locked position that is configured to retain the mounting pin within the pin receiver and biased to stay in an unlocked position that is configured to release the mounting pin from the pin receiver.

2. The wheelchair seat back assembly of claim 1 in which the taper of the mounting pin and the taper of the pin receiver are conically shaped.

3. A wheelchair seat back assembly comprising a seat back and mounting hardware for mounting the seat back in relation to seat posts, the mounting hardware comprising a mounting pin configured to be mounted in relation to one of the seat posts and the seat back, and a pin receiver having a latch assembly that includes a two-position locking lever, the pin receiver configured to be mounted in relation to the other one of the seat posts and the seat back, the mounting pin being structured to be received by the pin receiver to mount the seat back in relation to the seat posts, wherein the two-position locking lever is biased to stay in a locked position that is configured to retain the mounting pin within the pin receiver and biased to stay in an unlocked position that is configured to release the mounting pin from the pin receiver.

4. The wheelchair seat back assembly of claim 3 wherein the pin receiver is supported in relation to a mounting bracket by fasteners that pass through one or more slots in the mounting bracket, the fasteners mounting the pin receiver in relation to the mounting bracket, the slots being oversized to permit the pin receiver to be angularly adjustable in relation to the mounting bracket.

5. The wheelchair seat back assembly of claim 4 in which the mounting pin and the pin receiver are conically shaped.

6. The wheelchair seat back assembly of claim 3 wherein the latch assembly includes a resilient member that biases the two-position locking lever to stay in a locked position.

7. A wheelchair seat back assembly comprising a seat back and mounting hardware for mounting the wheelchair seat back in relation to wheelchair seat posts, the mounting hardware comprising a mounting pin configured to be mounted in relation to one of the wheelchair seat posts or the seat back and a pin receiver configured to be mounted in relation to the other one of the wheelchair seat posts or the seat back, the mounting pin being structured to be received by the pin receiver to mount the seat back in relation to the wheelchair seat posts, the mounting hardware further including a pivotally mounted locking lever configured to be pivoted between a locked position, in which the pin is locked in the pin receiver, and an unlocked position, in which the pin can be removed from the pin receiver, and wherein the locking lever, when pivoted to the unlocked position, is positioned in a relation with the mounting pin so that removal of the mounting pin from the pin receiver results in a pivoting of the locking lever to the locked position, and wherein when the locking lever is in the locked position, the wheelchair seat back can be re-mounted onto the wheelchair and locked in place by inserting the pin into the pin receiver, without requiring additional adjustment of the locking lever to achieve the locked position, and further wherein the mounting pin is tapered and the pin receiver is tapered, thereby enabling the tapered shape of the mounting pin to cooperate with the tapered shape of the pin receiver to form a firm contact between the mounting pin and the pin receiver.

* * * * *